US007686390B2

(12) United States Patent
Dennis

(10) Patent No.: US 7,686,390 B2
(45) Date of Patent: Mar. 30, 2010

(54) MOTION SIMULATION CHAIR

(75) Inventor: Warren E. Dennis, Santa Barbara, CA (US)

(73) Assignee: Montecito Research, Carpenteria, CA (US)

( * ) Notice: Subject to any disclaimer, the term of this patent is extended or adjusted under 35 U.S.C. 154(b) by 236 days.

(21) Appl. No.: 11/936,579

(22) Filed: Nov. 7, 2007

(65) Prior Publication Data

US 2009/0115232 A1 May 7, 2009

(51) Int. Cl.
*A47D 13/10* (2006.01)

(52) U.S. Cl. ..... 297/217.3; 297/273

(58) Field of Classification Search ..... 297/273, 297/276, 217.3

See application file for complete search history.

(56) References Cited

U.S. PATENT DOCUMENTS 1,950,042 A * 3/1934 Upper ..... 297/136
4,030,207 A 6/1977 Kron
4,567,614 A * 2/1986 Haider et al. ..... 5/124
4,793,009 A * 12/1988 Degen ..... 5/103
5,088,730 A 2/1992 Appleton
5,249,838 A 10/1993 Kulpa et al.
5,263,677 A * 11/1993 Puerner ..... 248/370
5,433,670 A 7/1995 Trumbull
5,509,631 A 4/1996 DeSalvo
5,526,893 A * 6/1996 Higer ..... 180/65.1
5,582,567 A 12/1996 Chang
5,695,406 A 12/1997 Park
5,769,725 A 6/1998 Ogden et al.
5,980,255 A 11/1999 Mathieu et al.
6,039,653 A 3/2000 Engstrand
6,168,551 B1 1/2001 McGuinness
6,733,293 B2 5/2004 Baker et al.

* cited by examiner

*Primary Examiner*—Sarah B McPartlin
(74) *Attorney, Agent, or Firm*—Felix L. Fischer

(57) ABSTRACT

A motion simulation chair incorporates a base providing elevated attachment points for a number of support cables. A seat support is carried within the base and engages a seat for an occupant at a top end. The seat support has companion attachment points for the support cables at a bottom end. A control system incorporates a forward vertical control element constrained for three axis motion about a control point. A horizontal control element displaced upward from the control point and extending rearward from the forward vertical control element, engages the seat support. A control stick operated by the user imparts motion to the forward vertical control element about the control point. Moving the horizontal control element alters the suspension angles of the cables providing a corresponding tilt of the seat support and seat for realistic simulation of motion resulting from inputs to a computer game by the control stick.

15 Claims, 14 Drawing Sheets

MOTION SIMULATION CHAIR

BACKGROUND OF THE INVENTION

1. Field of the Invention

This invention relates generally to the field of motion simulators and more particularly to a chair and mechanical support system providing motion capability in response to physical control inputs by a user associated with inputs to a videogame or other simulation with associated motion.

2. Description of the Related Art

Computer video games provide numerous simulations which involve aircraft, spacecraft or other moving vehicles. The realistic video presentations provide an exciting game playing environment for the user. The ability to have actual motion of a chair in which the user sits significantly enhances the virtual reality provided by the game. Motion base simulators for aircraft pilot training and other similar devices have been available for some time; however, such devices are very complicated and expensive.

Arcade games and amusement park games which employ video have been developed which include some movement of the user's seat. However, such games are typically unavailable for purchase by individual users and like commercially available flight simulation systems are extremely expensive. Further, the arcade game systems are typically single game units without capability for variation of games.

It is therefore desirable to provide a system to create motion simulating the environment created in a video game for a user in an inexpensive and simple mechanical device.

SUMMARY OF THE INVENTION

The present invention provides a motion simulation chair having a base providing elevated attachment points for a number of support cables. A seat support is carried within the base and engages a seat for an occupant at a top end. The seat support has companion attachment points for the support cables at a bottom end. A control system incorporates a forward vertical control element constrained for three axis motion about a control point. A horizontal control element displaced upward from the control point and extending rearward from the forward vertical control element, engages the seat support. A control column or joy stick operated by the user imparts motion to the forward vertical control element about the control point. Moving the horizontal control element alters the suspension angles of the cables providing a corresponding movement and tilt of the seat support and seat.

BRIEF DESCRIPTION OF THE DRAWINGS

These and other features and advantages of the present invention will be better understood by reference to the following detailed description when considered in connection with the accompanying drawings wherein.

DETAILED DESCRIPTION OF THE INVENTION

An embodiment of the invention is described herein with respect to use with video games or computer simulations. In alternative uses, a chair employing the invention could be used with an interactive movie, television program, internet site or any other plot or action driven entertainment media. All current active video game chairs or active simulators rely on input/controls from the computer or media source to move the simulation chair in concert with the motion of the visual image. With the present invention the user's physical movement of the chair's control induces motion in the chair and in advanced embodiments simultaneously sends matching directional signals to the media to produce corresponding visual appearance of motion within the media. The simplest example is a flight simulator. In this application, the user moves the chair's control to both change the direction of the airplane in the video flight simulator and to induce the corresponding movement of the chair.

Figure 1:
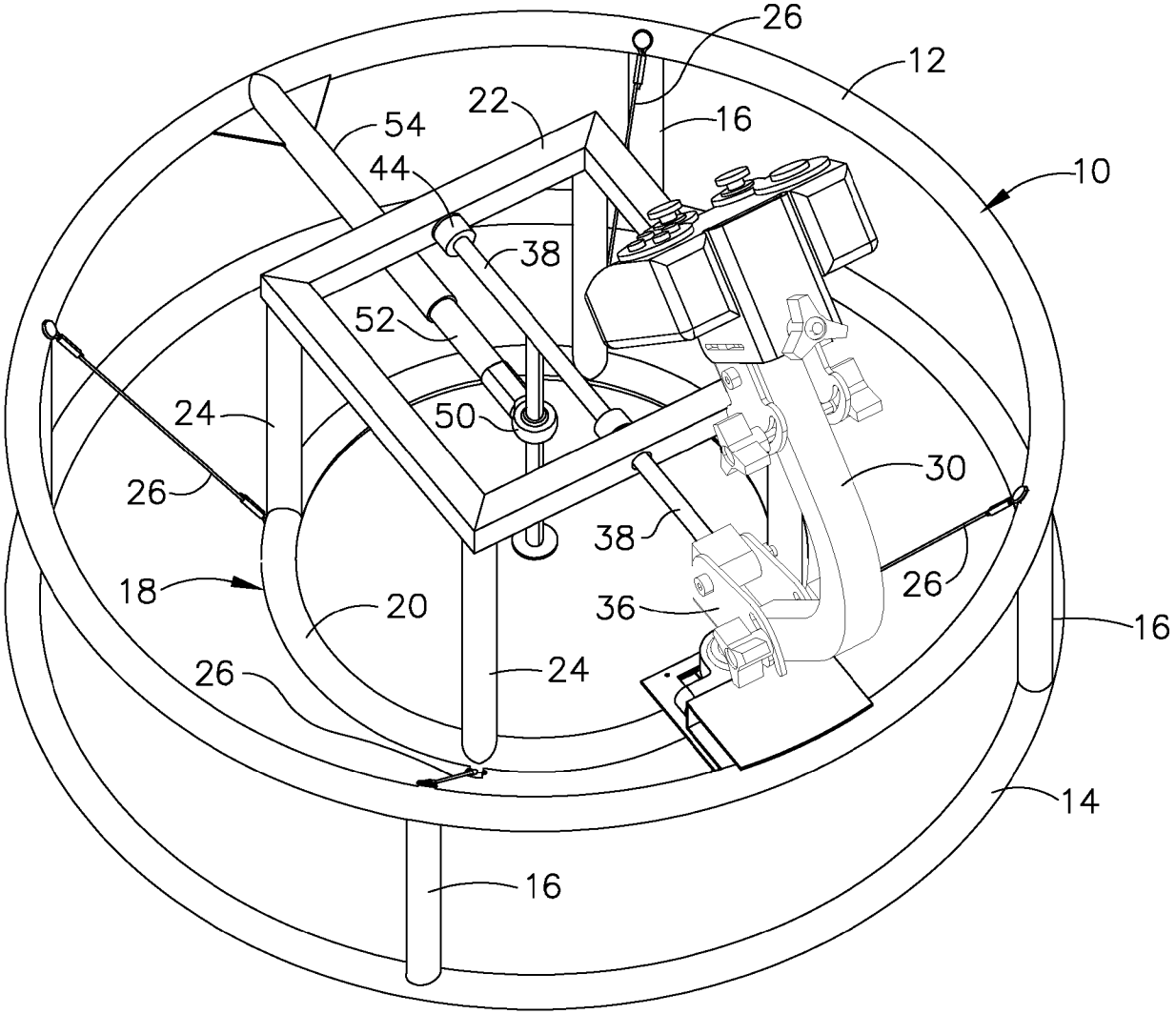
FIG. 1 is an isometric view of the support and control elements of a first embodiment of the invention.
Figure 2:
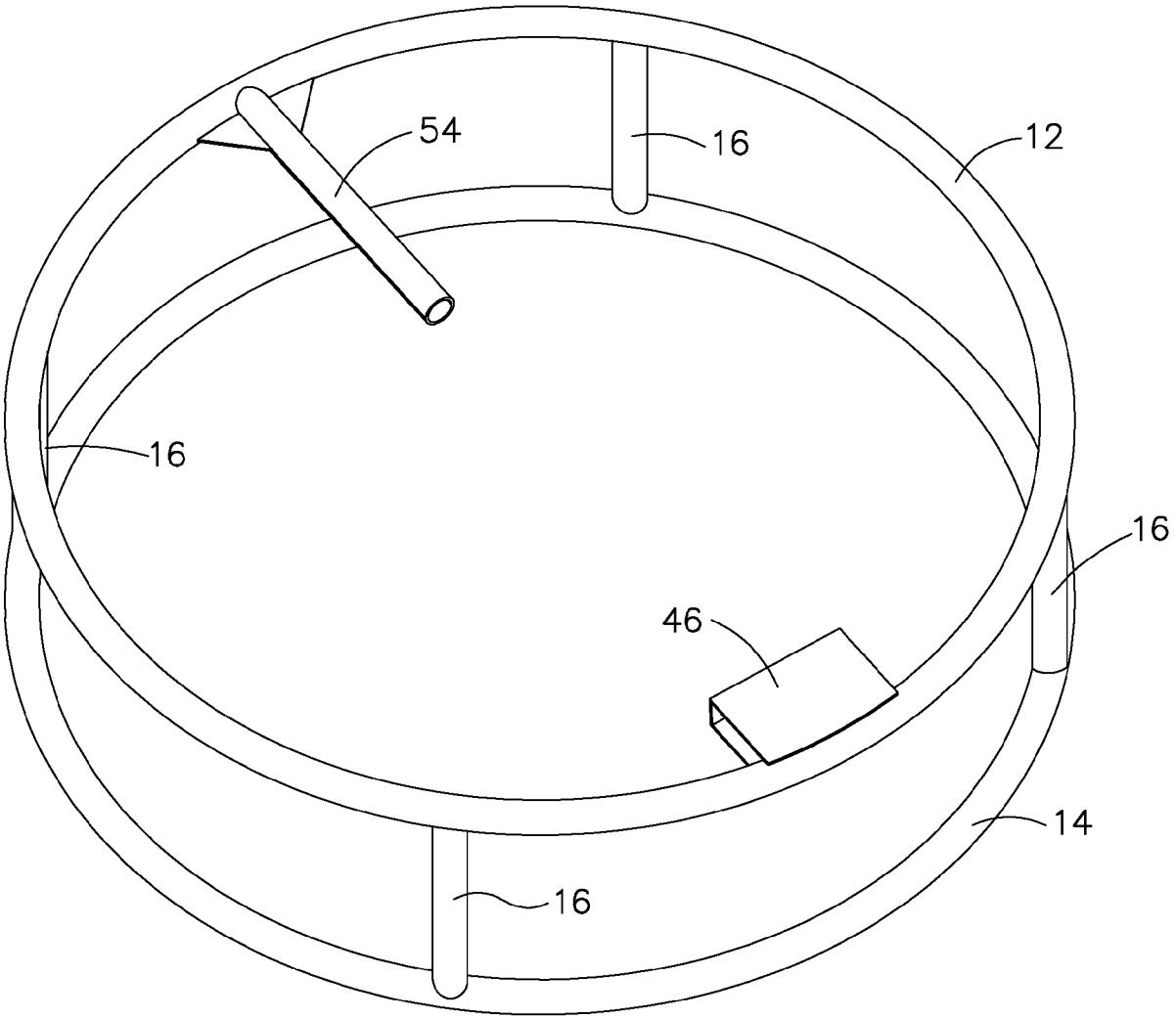
FIG. 2 is an isometric view of the supporting base of the first embodiment.

Referring to the drawings, FIG. 1 shows a first embodiment of a support and control structure incorporating the present invention. A supporting base 10 rests on the floor providing a rigid support for the motion simulation system. For the embodiment shown, the base detail is shown in FIG. 2 and incorporates a circular top connection ring 12 and a circular bottom rest ring 14. The top connection ring is supported from the bottom rest ring by columns 16.

Figure 3:
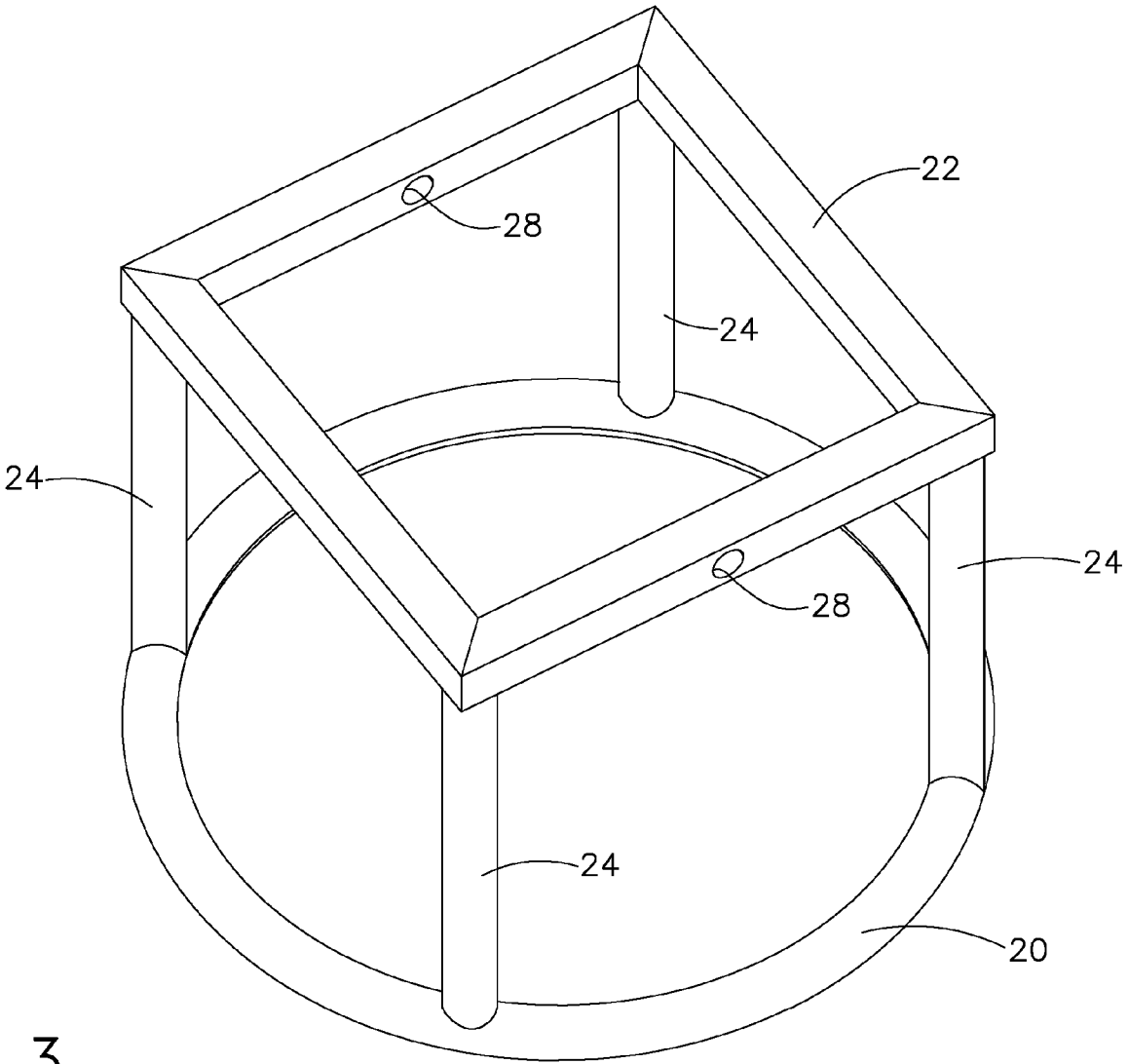
FIG. 3 is an isometric view of the seat support of the first embodiment.

Carried within the supporting base is a seat support 18. The seat support of the first embodiment shown in FIG. 1 and in detail in FIG. 3 includes a suspension ring 20 and a control connection square 22 supported from the suspension ring by columns 24. The control connection square provides support for an attached seat (not shown) and rigid connection for the controls as will be described in greater detail subsequently. The suspension ring is connected to the top connection ring of the base by cables 26. This support arrangement allows motion of the seat support in pitch and roll relative to the base about a neutral positively stable initial position by altering the relative angles of the support cables. For the embodiment shown, the cables attach at four support corners laterally displaced from a centerline of the seat support.

Figure 4:
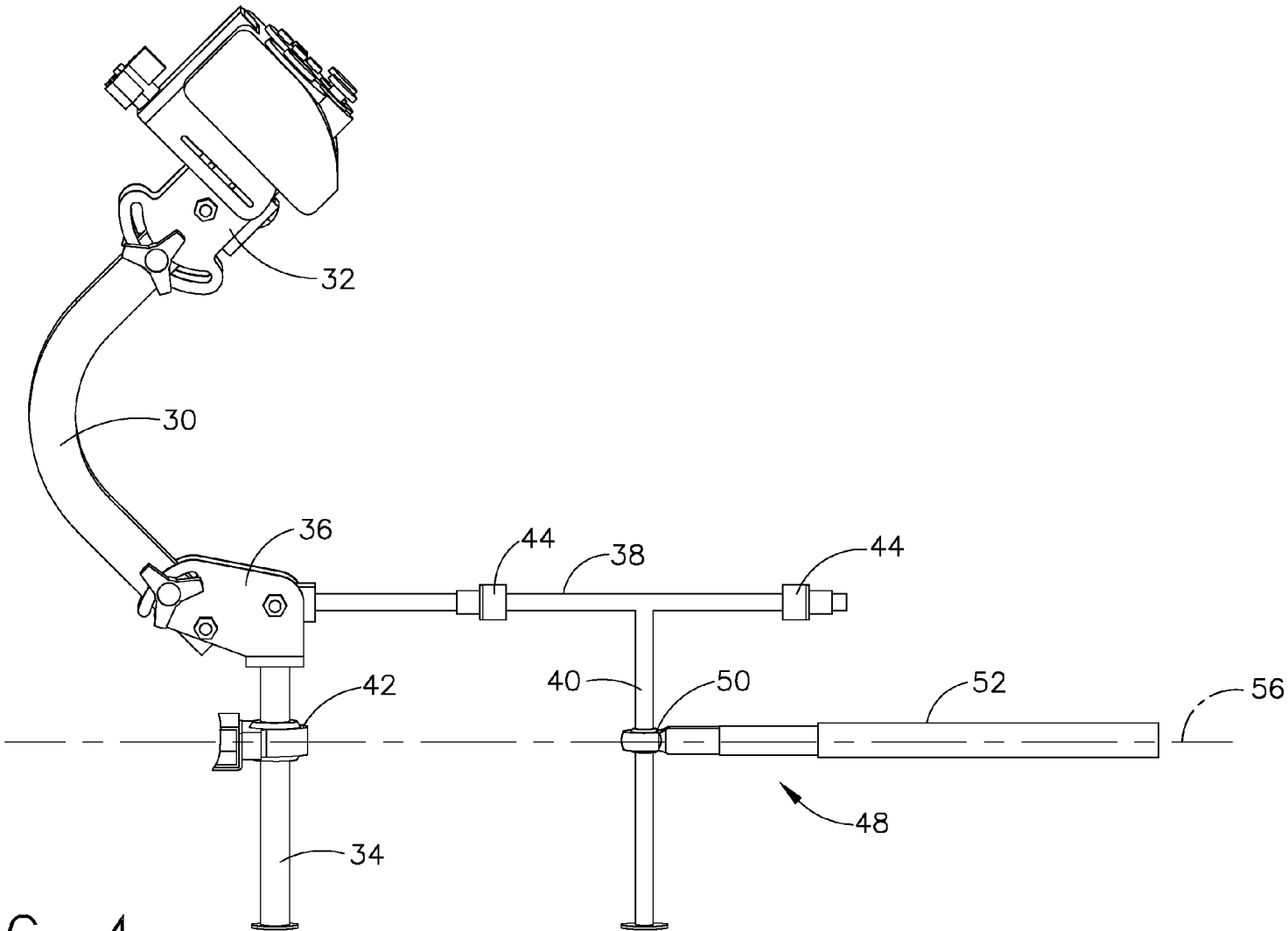
FIG. 4 is a side view of the control structure of the first embodiment.
Figure 5:
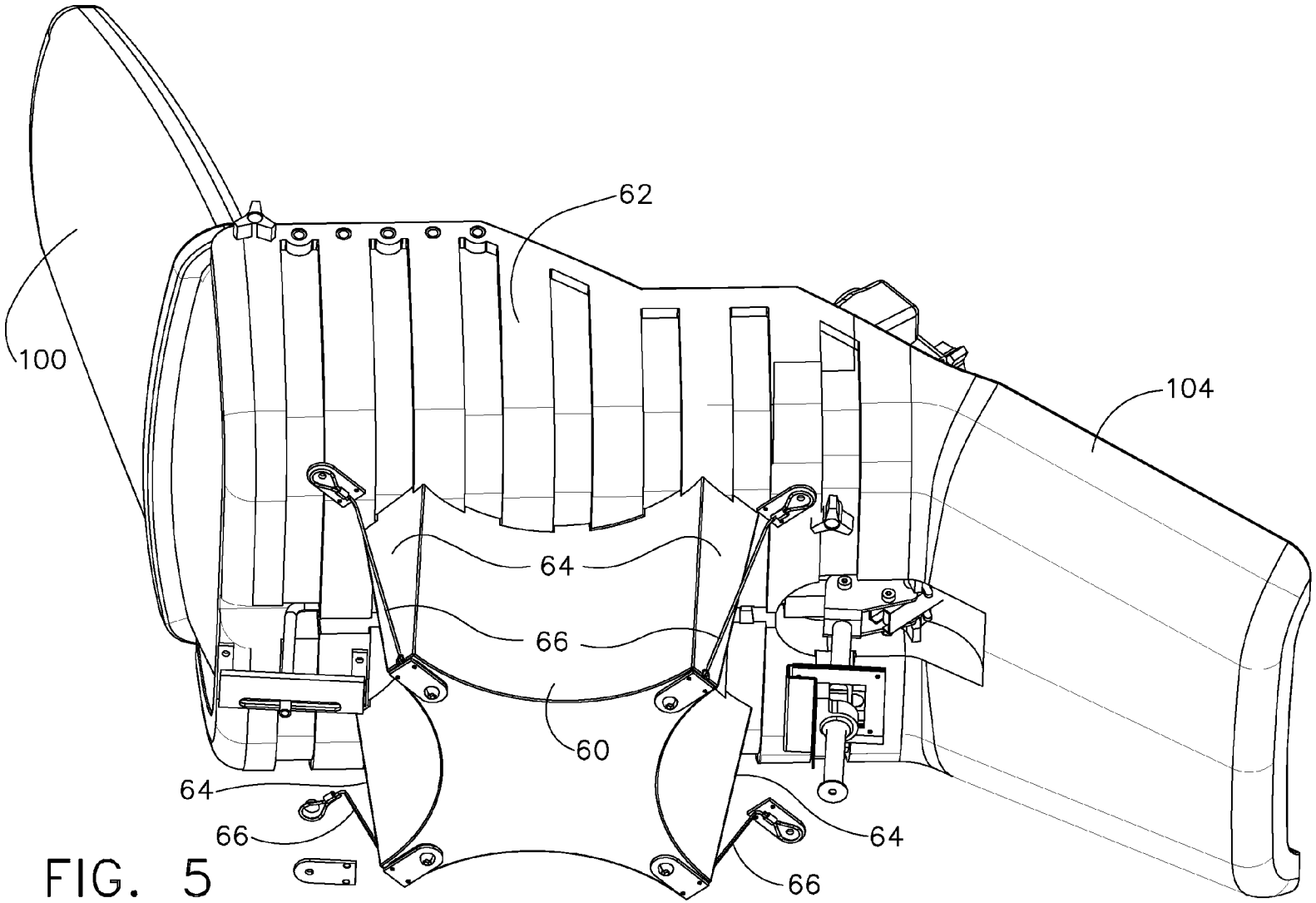
FIG. 5 is a bottom isometric view of a second embodiment of a seat and seat support with control structure.
Figure 6:
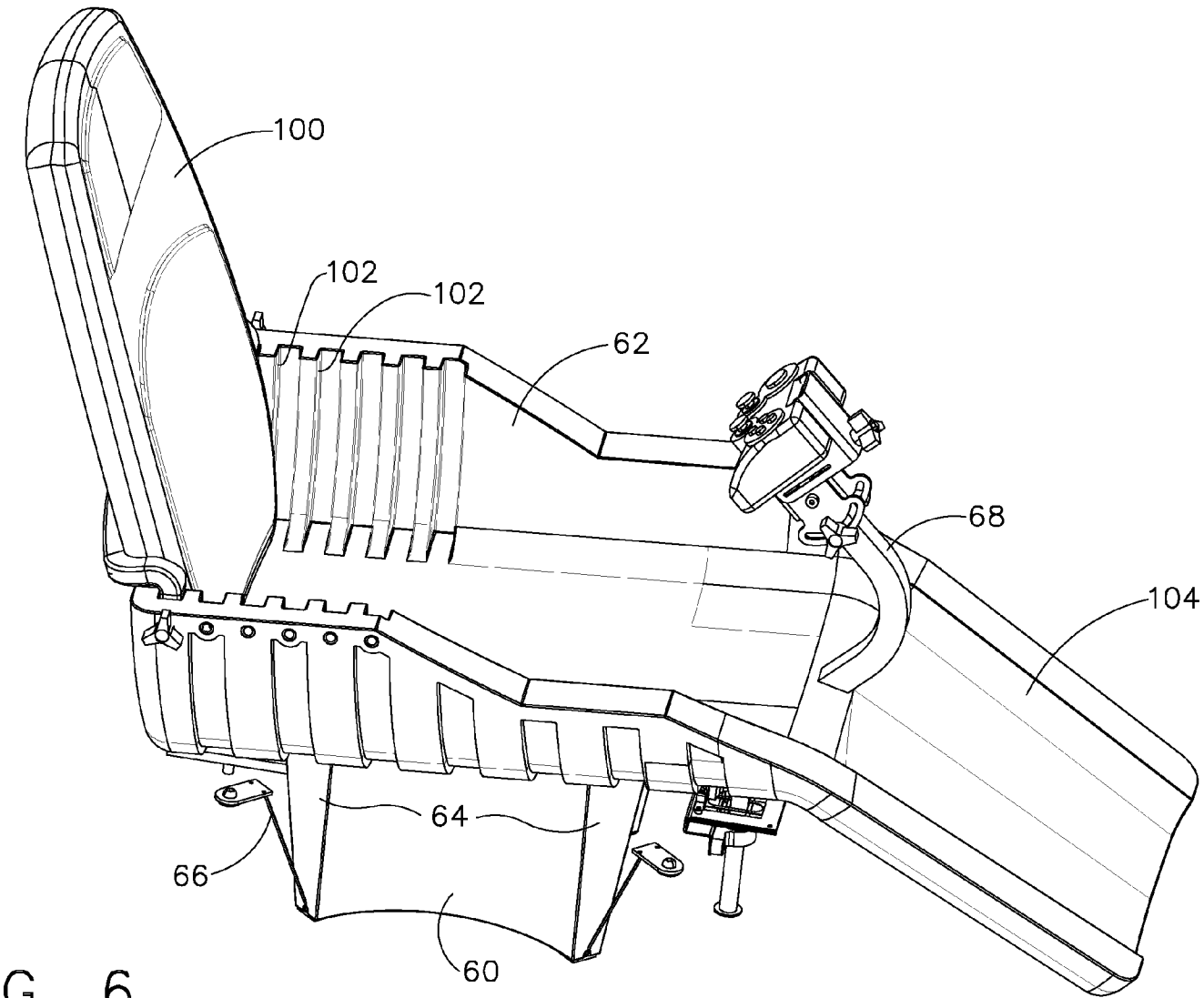
FIG. 6 is a top isometric view of the seat and seat support with control structure of FIG. 5.

The elements of the control structure as shown in FIG. 1 and in detail in FIG. 4 include a control column 30 or "joy stick" which allows control of the motion simulation seat by the occupant. The control column includes controller brackets 32 for connection of convention video game controllers or other electronic devices for interaction with a computer video game as will be described in greater detail subsequently. The control column attaches to a forward vertical control post 34. In alternative embodiments, the control column may be an extension of the vertical control post. In the embodiment shown in the drawings, a column connection bracket 36 is employed in the embodiment shown for adjustable connection of the control column to the vertical control rod. A horizontal control shaft 38 extends rearward from the control column and vertical control post. The shaft is rigidly attached to the seat through control connection square with inserts 44 received in bores 28 in the connection square and directly imparts motion to the seat as will be described in greater detail subsequently.

A rear vertical control rod 40 extends downward from the control shaft to engage an aft control connection described in detail subsequently. The forward vertical control post extends through and is restrained by a ball mount 42 which is rigidly attached to the base. The ball mount allows reciprocating motion of the post axially through the mount and allows rotation of the post by spherical displacement of the ball within its socket. For the embodiment shown, a ball mount attachment flange 46 extends from the top connection ring.

The rear vertical control rod passes through and is constrained by a rear articulating joint assembly 48. The rear articulating joint assembly provides mobility in three axes for the rear vertical control rod in the embodiment shown. For the first embodiment, the rear articulating joint includes a rear ball mount 50 attached to a slip rod 52 received in a telescope barrel 54 mounted to the base. The slip rod is rotatable about its axis within the telescope barrel and axially extendible into and out of the barrel. For the forward ball mount and rear ball mount a "uniball" structure is employed in exemplary embodiments. A KSTM-16 base mounted nylon sleeve bearing produced by IGUS is employed in examples of the embodiments shown. The forward vertical control post, horizontal control shaft and rear vertical rod form a pinned structure with the post and rod orthogonal to the shaft. The location of the horizontal shaft is upward from the ball mount which acts as the motion control point.

In operation, the seat support and an attached seat is suspended by the cables at a neutral point absent input from the occupant through the control column. In conjunction with operation of the standard controller connected to the video game, the player occupying the seat pushes on the control column. When the seat occupant pushes forward on the control column, the forward vertical control post rotating forward about the ball joint urges the horizontal control shaft forward which slightly moves the seat support forward changing the angle of the rear cables relative to the vertical to a more obtuse angle with the front cables adopting a more acute angle allowing the seat support suspension ring to adopt a forward tilt providing a pitch down motion for the seat. The forward vertical control post is also urged downward along its axis through the ball mount while rotating forward to provide mechanical relief for angle adjustment within the system. The rear vertical control rod provides reacting forces to maintain alignment of the seat support. The rear vertical control rod slides axially upward through rear ball mount in the rear articulating joint, and the slip rod is urged axially out of the receiving telescope barrel. Releasing pressure on the column returns the seat to its neutral point. Suspension of the seat support from the top connection ring of the base to the suspension ring on the seat support provides positive static stability.

Similarly, pulling on the control column urges the rigidly attached horizontal control shaft rearward with the seat creating a more obtuse relative angle in the front cables and a more acute angle in the rear cables tipping the front of the seat support upward providing a pitch up motion for the seat. The forward control post slides axially upward through the ball mount and the rear vertical control rod slides axially downward through rear ball mount in the rear articulating joint with the slip rod urged axially into the receiving telescope barrel for angular relief.

Pushing the control column right causes the horizontal control shaft to be rotated clockwise about an axis 56 (best seen in FIG. 4) extending through the ball joints. Reaction of the front vertical control post and rear vertical control rod in their respective ball mounts moves the seat support which is rigidly attached to the shaft to the right increasing the angle in the right supporting cables and decreasing the angle in the left supporting cables resulting in a right roll position for the seat support and seat.

Similarly, pushing the control column left causes the horizontal control shaft to be rotated counter-clockwise about the axis extending between the ball joints. Reaction of the front vertical control post and rear vertical control rod in their respective ball mounts rotates the seat support into a left roll position.

A second embodiment of the invention is shown in FIGS. 5, 6, 7 and 8 wherein a seat support 60 is rigidly attached to a seat pan 62. Corner pillars 64 in the support provide the bottom attachment for supporting cables 66. As in the prior embodiment, a control column 68 is attached to a forward vertical control post 70 and a horizontal control shaft 72. A bracket 74 provides engagement for the column, post and shaft. As in the first embodiment, the forward vertical control post is received in a ball joint 76. Force reaction at the rear of the horizontal control shaft is provided by a rear vertical rod 78 depending from the shaft and engaged by a receiver 80 having a slot 82. For the embodiment shown in the drawings, the rear vertical rod is an integral element with the horizontal shaft with a "hockey stick" configuration. As in the first embodiment, the forward vertical control post, horizontal control shaft and rear vertical rod form a rigid structure with the post and rod orthogonal to the shaft. The receiver allows the rear vertical rod to move longitudinally forward and rearward in the slot, to be angled in the slot and to be axially inserted and withdrawn through the slot providing the three axes of motion as previously described for the rear articulating joint of the first embodiment. This provides freedom for motion of the seat base and seat as rigidly connected to the horizontal shaft in the pitch directions while providing lateral reaction forces necessary to maintain the forward vertical control post and rear vertical control rod in a planar alignment thereby avoiding yaw motion or other instability in combined roll and pitch motions of the seat. The receiver is supported for rotation about its axis to constrain the rear vertical rod for force reaction in roll.

Figure 7:
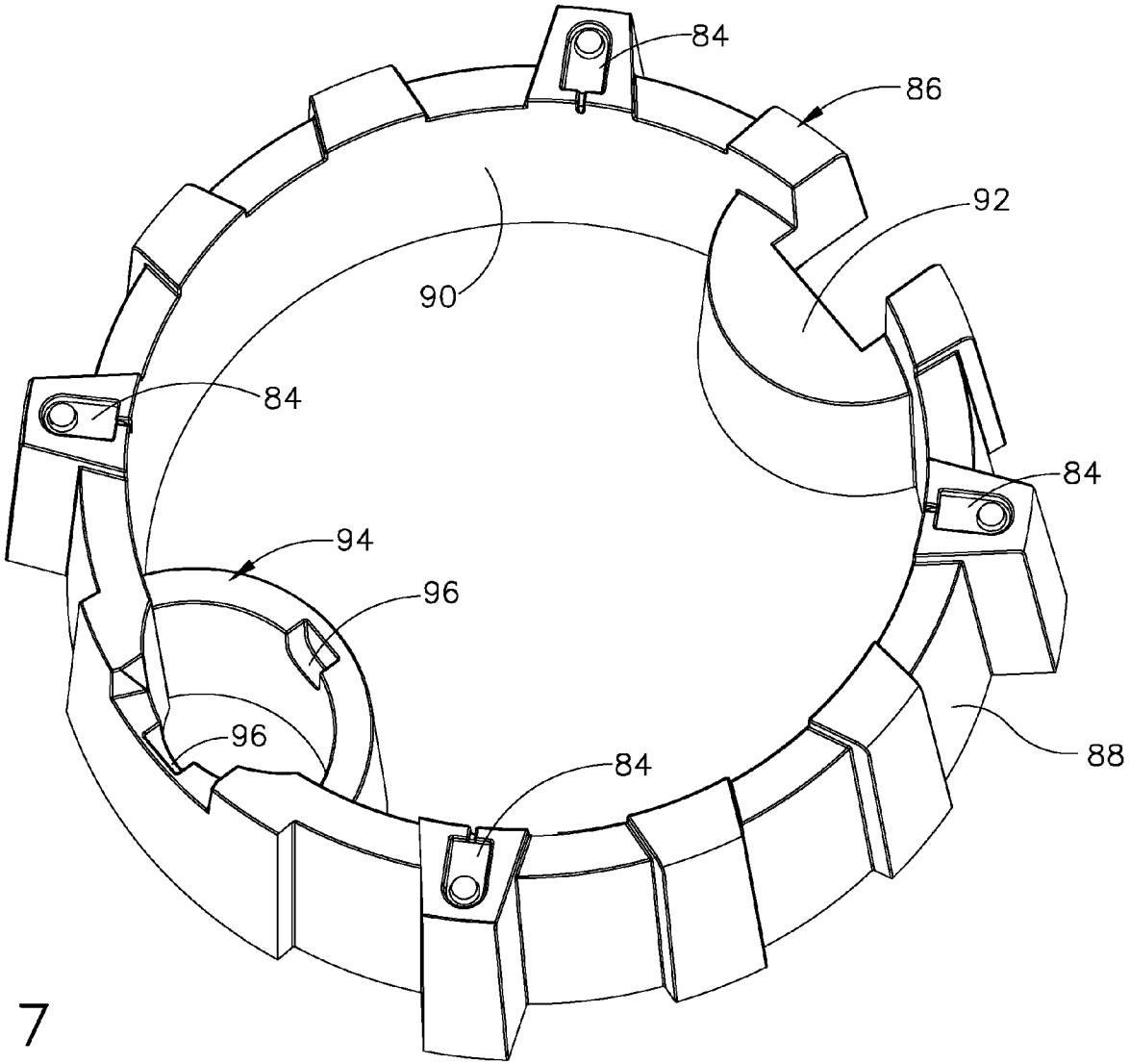
FIG. 7 is a top isometric view of the supporting base of the second embodiment.
Figure 8:
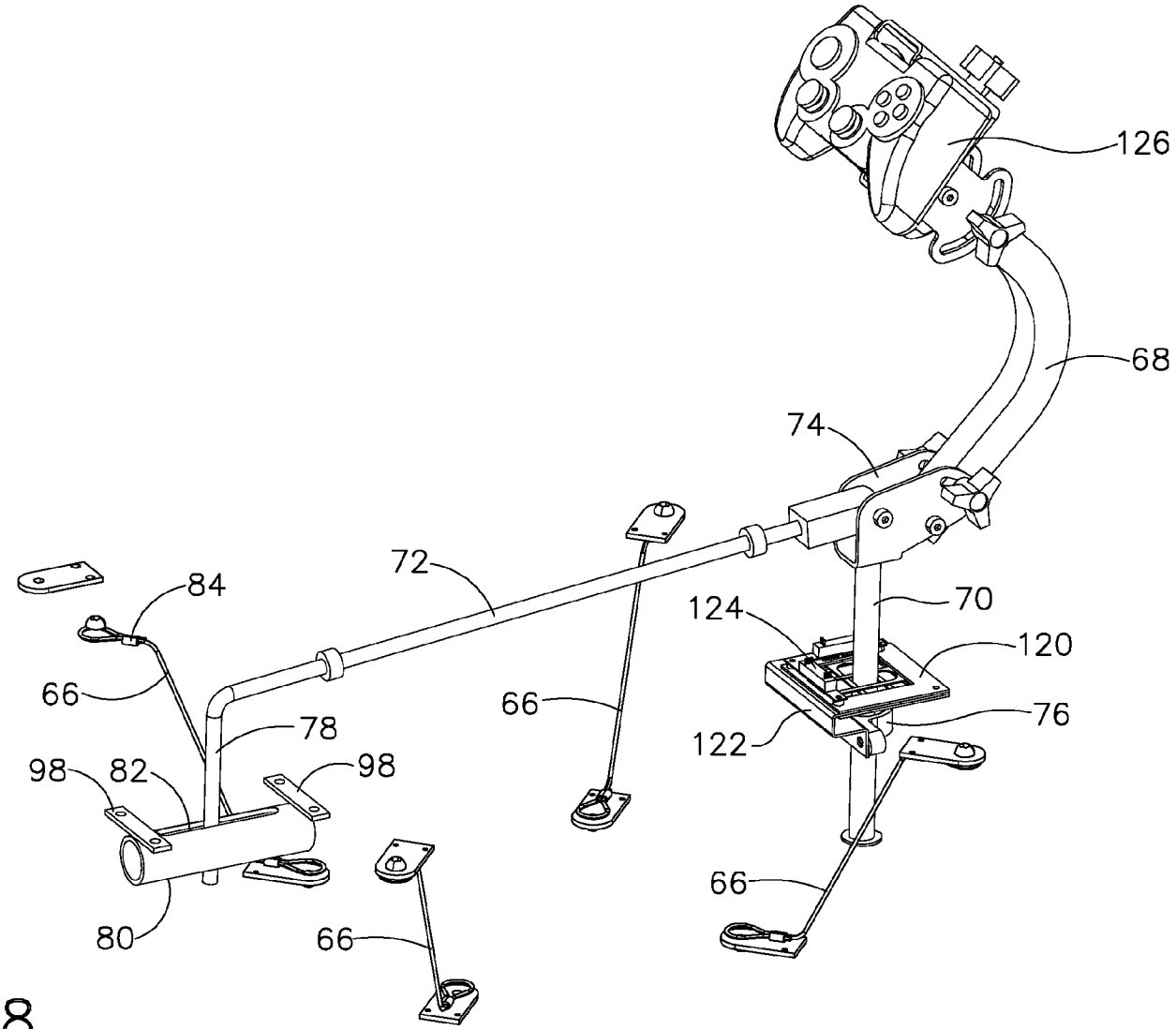
FIG. 8 is a side isometric view of the control structure of the second embodiment.

Support cables 66 attach from the corner pillars on the seat support to support landings 84 on a base 86 best seen in FIG. 7. The base is fabricated as a frustoconical element having a bottom 88 resting on the floor and a central chamber 90 receiving the seat support. A first integrated landing 92 provides an attachment for the ball joint engaging the forward vertical control post. A second integrated boss 94 provides attachment saddles 96 engaging the ends of the receiver. Plates 98 (shown in FIG. 8) constrain the receiver ends in the saddles. For the embodiments shown in the drawings, the horizontal control shaft is shown as a separate element. In alternative embodiments, the horizontal control element may be integrated into the seat support or seat as a molded feature receiving the forward vertical control post and rear vertical control rod. Additionally, while the support landings are shown in a horizontal configuration in the drawing embodiments, vertical attachment of end tabs on the cables to the base is provided in alternative embodiments.

Figure 9A:
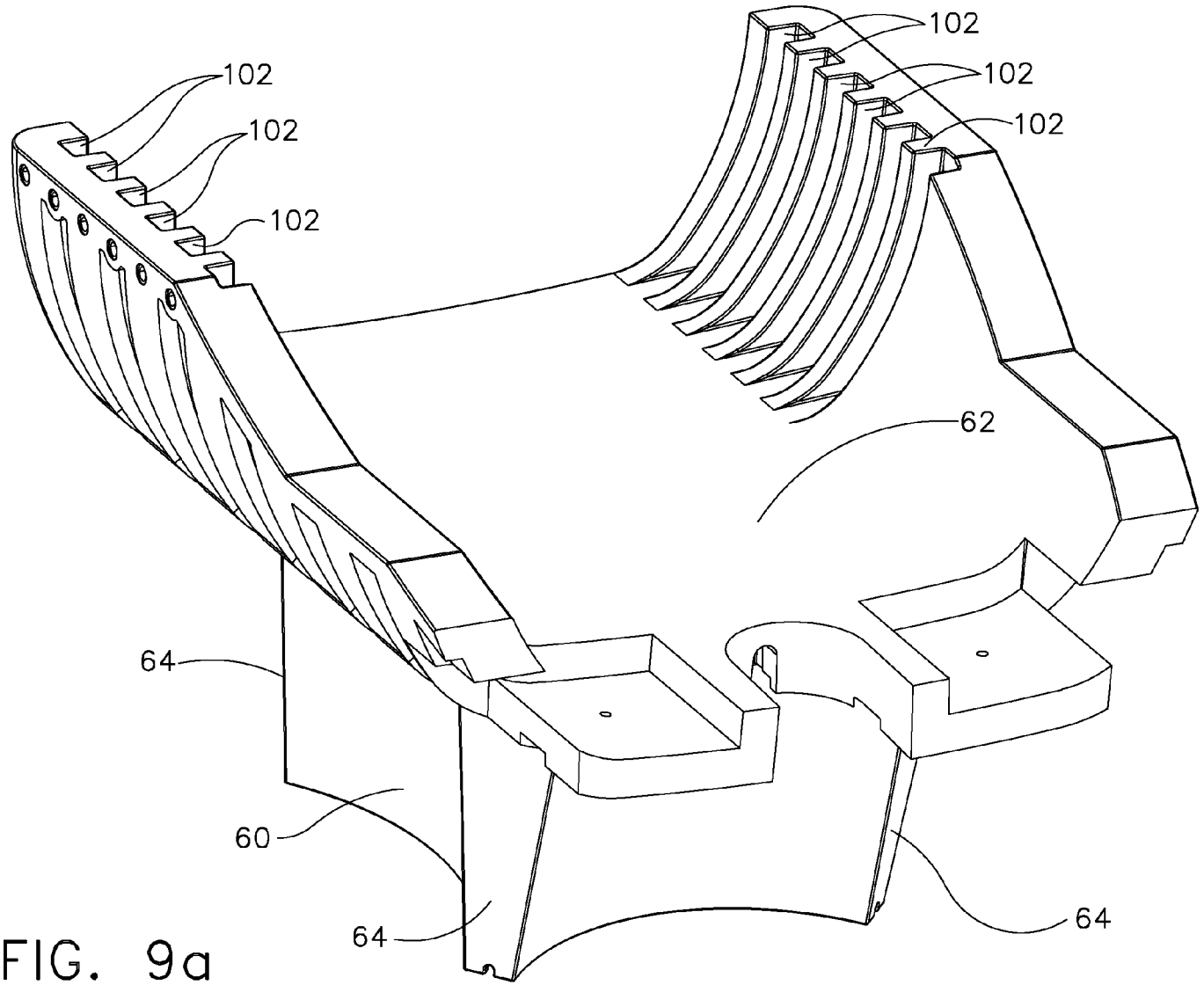
FIG. 9A is a top isometric of the seat bottom with integral seat support of the second embodiment.
Figure 9B:
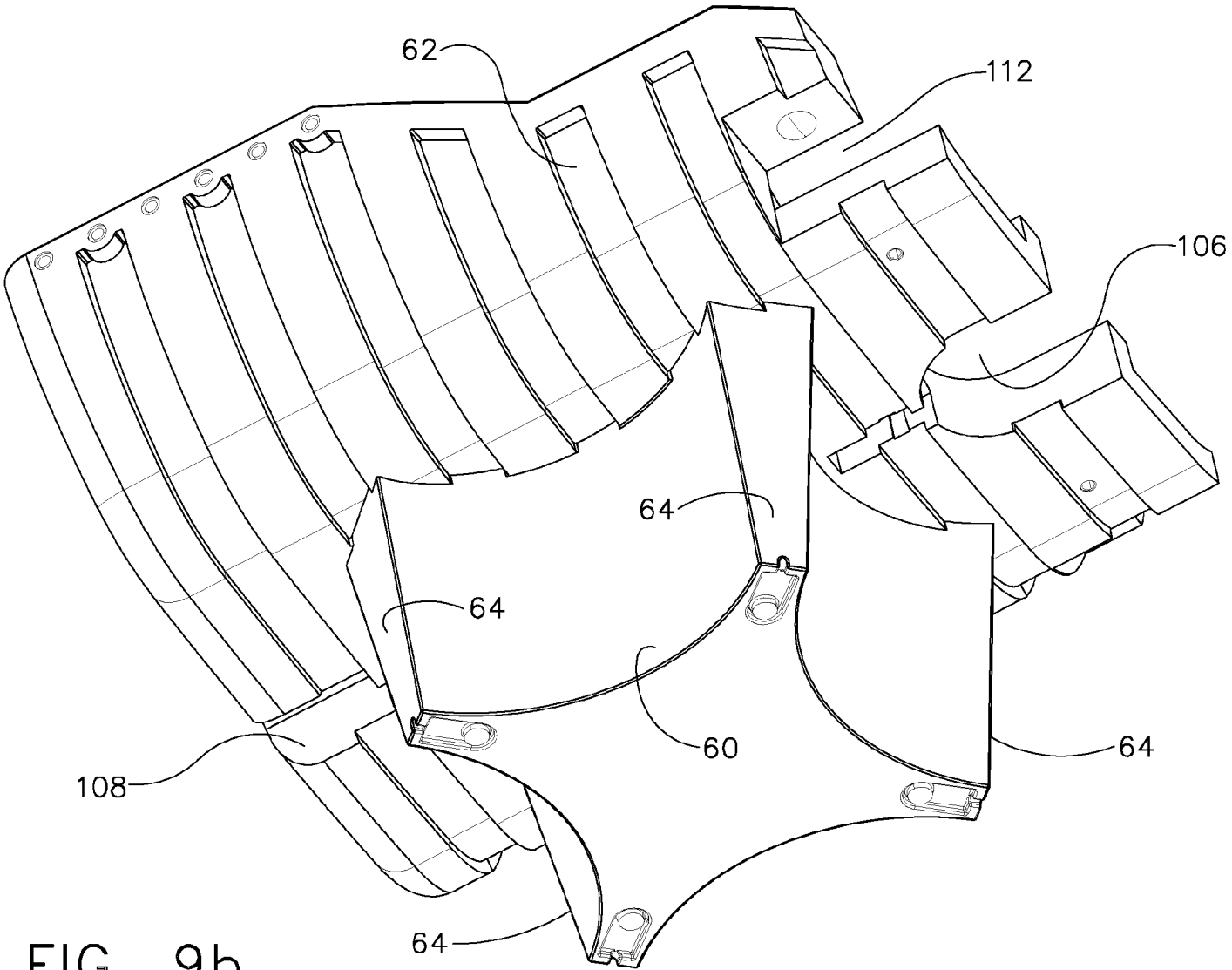
FIG. 9B is a bottom isometric of the seat bottom and integral seal support of FIG. 9A.
Figure 9C:
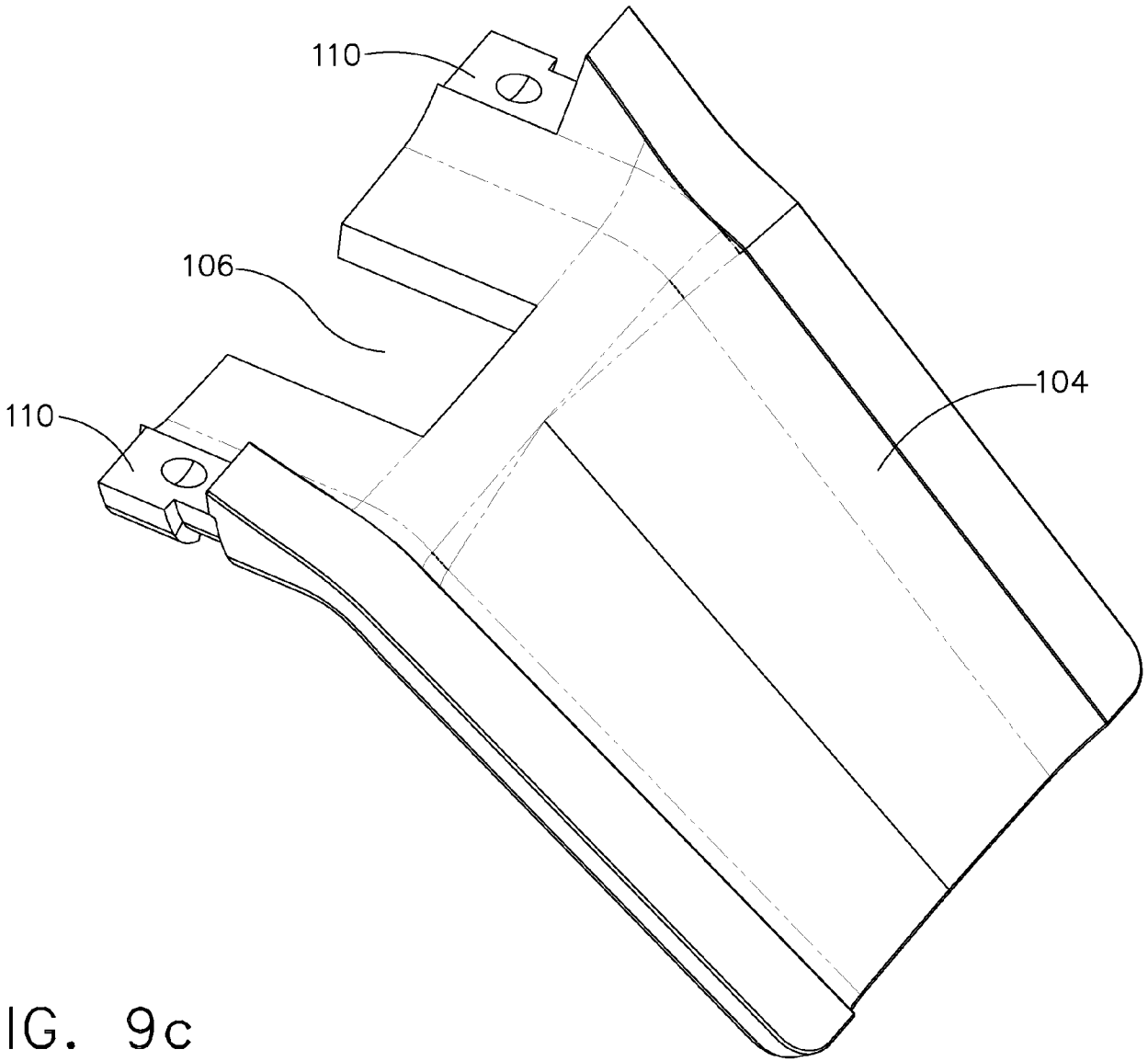
FIG. 9C is a top isometric of a leg rest attaching to the seat bottom for the second embodiment.
Figure 9D:
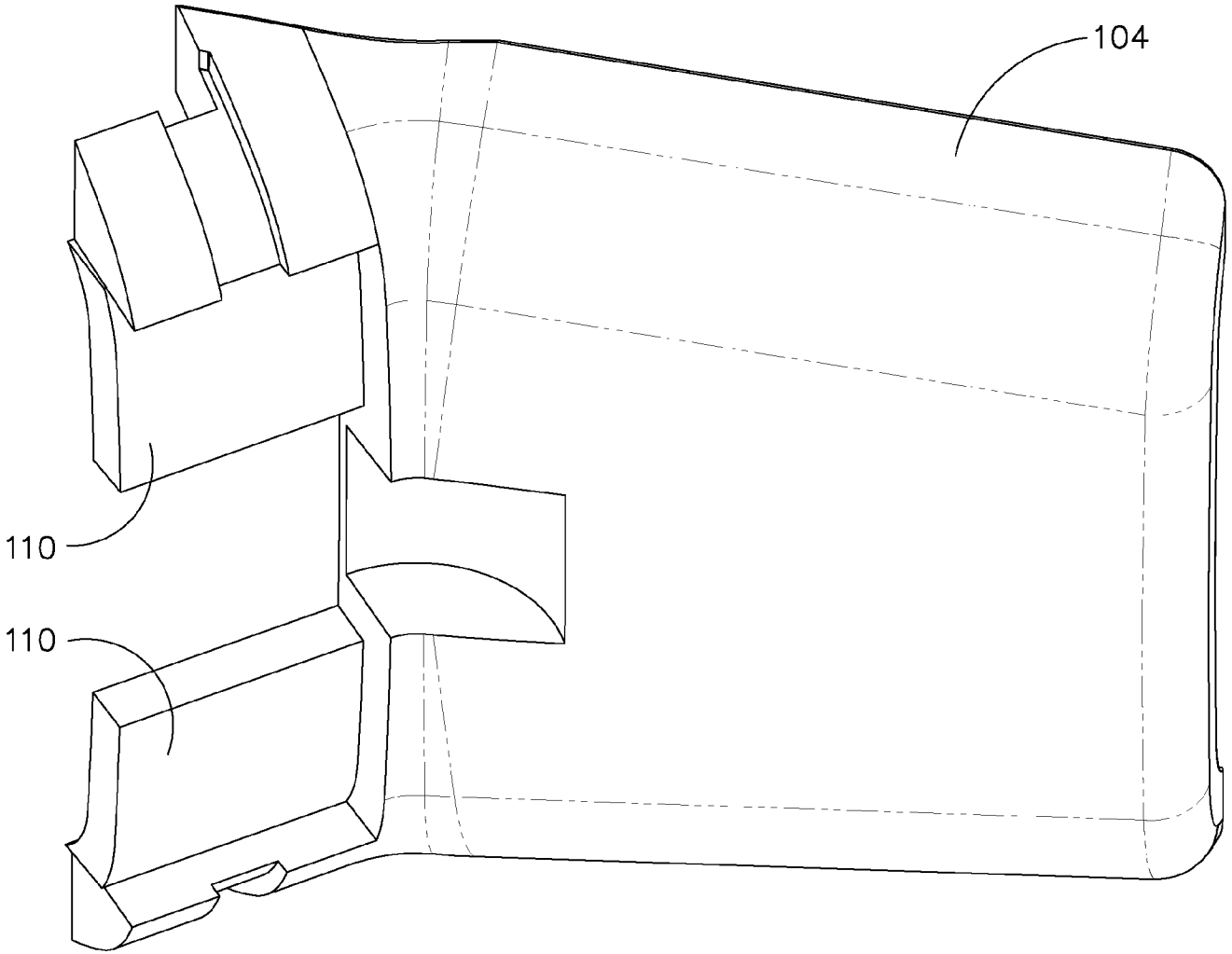
FIG. 9D is a bottom isometric of the leg rest of FIG. 9C.
Figure 9E:
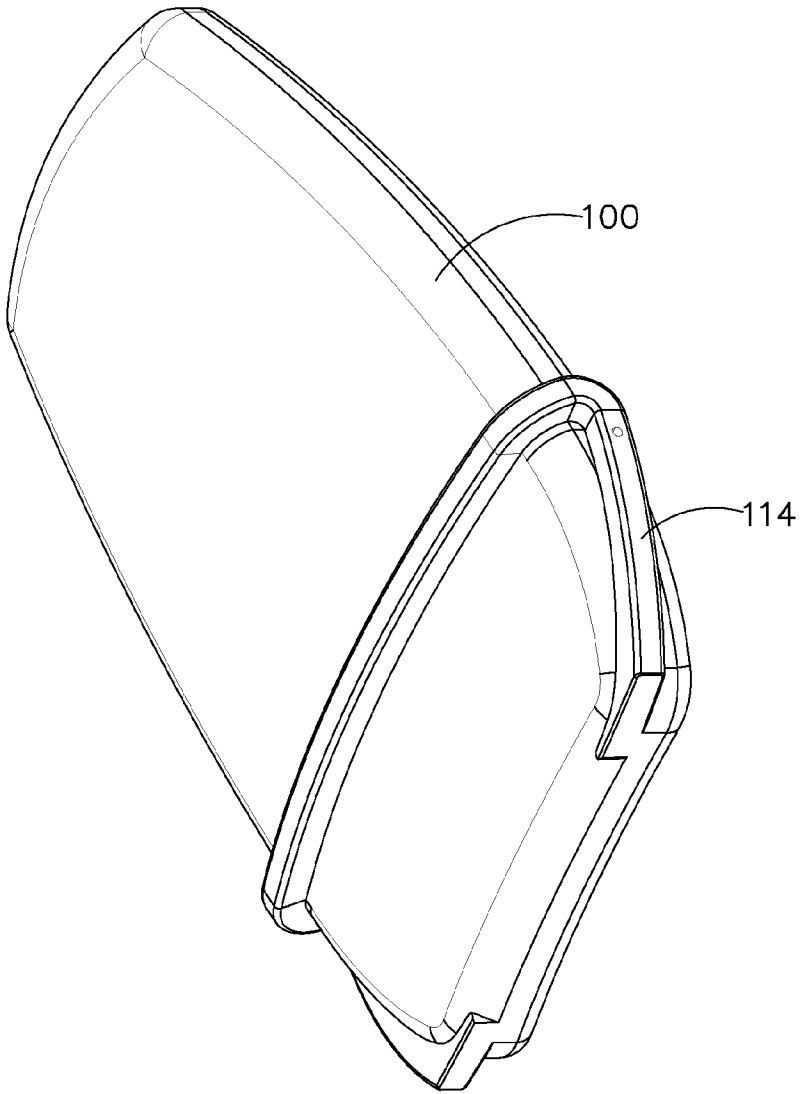
FIG. 9E is a rear isometric of a seat back attaching to the seat bottom for the second embodiment; and, FIG. 9F is a front isometric of the seat back of FIG. 9E.
Figure 9F:
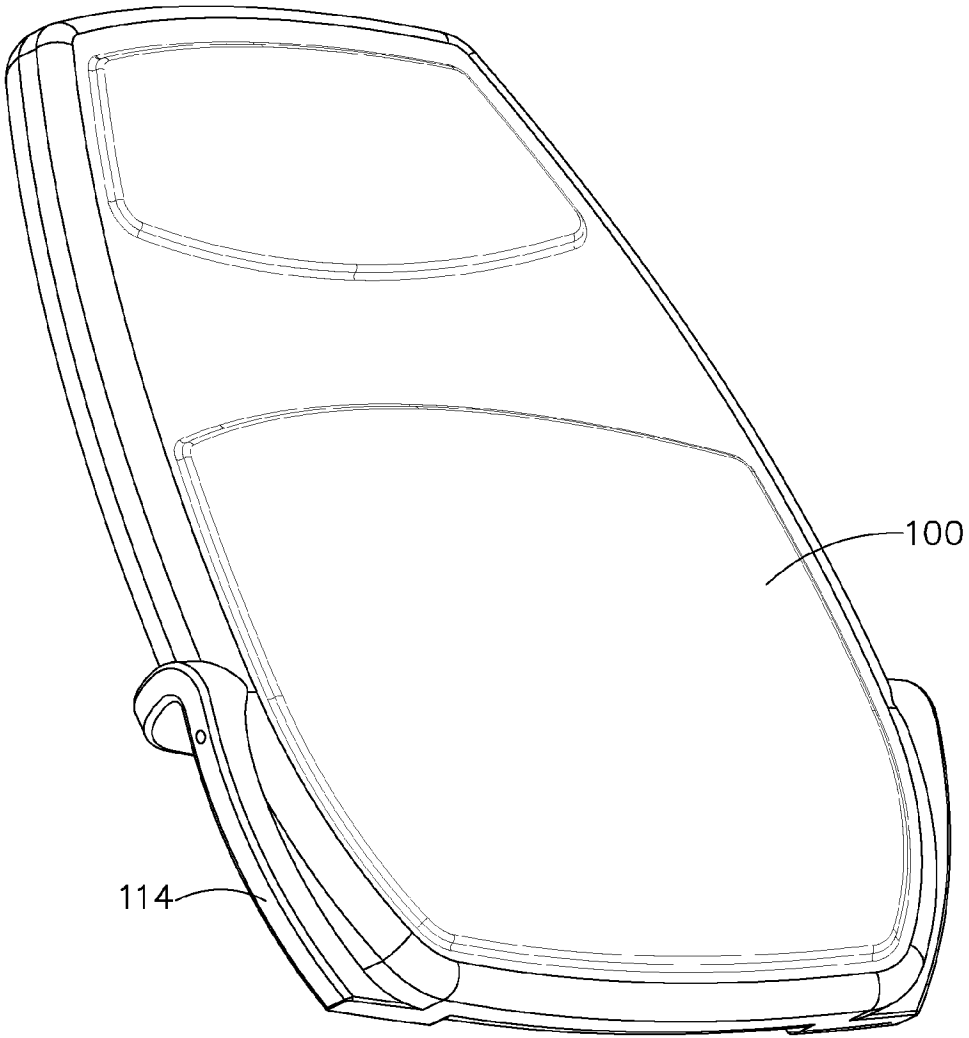

For the embodiment shown in the drawings, a seat back 100 is received in selected pair of adjustment slots 102 in the seat pan. The placement of the seat back allows adjustment for the length of the occupant's thigh as well as providing center of gravity adjustment for optimal performance of the motion simulation with control balance. A lower leg support 104 attaches to the front of the seat pan. Details of the seat pan with the depending seat support, the seat back and leg rest are seen in FIGS. 9A-9F. For the embodiment shown, the seat elements as well as the base previously described with respect to FIG. 7 are formed from molded poly styrene covered foam, fiberglass or similar composite structure for light weight with high rigidity. As shown in FIGS. 9B and 9C, the seat pan and leg rest interface includes an aperture 106 through which the control column extends and the seat pan includes a bore 108 receiving the horizontal control shaft for rigid attachment. The leg rest incorporates tenons 110 received in mortise cutouts 112 in the seat pan for inter-engagement to secure the leg rest to the seat pan. FIGS. 9E and 9F show details of the seat back including engagement ridge 114 received in the slots of the seat pan.

For the various embodiments shown in the drawings and described herein, the base and support elements are shown as circular. Alternative geometric shapes sufficient for interactive suspension of the seat support within the base and attachment of the seat to the support may be employed in alternate embodiments of the invention. In alternative embodiments, the mechanical leverage elements for control can be a single rod extending above the seat passing down through both a pivot point (ball joint) attached to the chair and on to a pivot point (ball joint) attached to the fixed base. By moving the upper end of the rod in any direction from the center, or the at-rest position, the chair will move in the same direction relative to the base. This motion results in a change of support angle for the cables relatively lengthening the elevation of cables in the direction of motion (a more acute angle with respect to the vertical) and shortening the elevation of cables opposite the direction of motion to tilt the chair. By way of example, pushing the rod forward will move/tilt the chair forward. Pulling the rod back will move/tilt the chair back. Release the control and the chair will return to its center, at-rest position. Similar motion can be had to any point of the compass Returning to FIG. 8, the present invention incorporates a sensor module 120 supported by a bracket 122 attached to landing 92 in the base for rigid support. The control column extends through the sensor for detection of relative motion in multiple axes. Data from the sensor may be provided through potentiometers 124 connected to a computer as input for interaction with a video game with which the motion simulation chair is being employed. As an exemplary operation, the input from the motion sensor may be employed to replace joystick input from standard controller 126 for visual scene pan and tilt in the video game. This avoids any control mismatch between the physical motion of the motion simulation chair and input by the player/occupant for vision tilt/pan thereby enhancing the gaming experience.

The present invention as described for the exemplary embodiments herein provides a simple mechanical system for providing a motion simulation system to be used in conjunction with computer video games or similar devices such as Microsoft X-Box® or Sony Playstation® where visual imagery is provided. Controllers for the electronic interaction with the gaming device are easily mountable on the control column as described and the simple control induced motion by the occupant/player significantly adds to the virtual reality of the gaming experience.

Having now described the invention in detail as required by the patent statutes, those skilled in the art will recognize modifications and substitutions to the specific embodiments disclosed herein. Such modifications are within the scope and intent of the present invention as defined in the following claims.

What is claimed is:

1. A motion simulation chair comprising:

a base providing elevated attachment points for a plurality of support cables;

a seat support carried within the base and engaging a seat for an occupant at a top end and having companion attachment points for the plurality of cables at a bottom end;

a control system having a forward vertical control element constrained for three axis motion about a control point;

a horizontal control element displaced upward from the control point and extending rearward from the forward vertical control element, the horizontal control element rigidly engaging the seat support;

means for imparting motion to the forward vertical control element about the control point wherein moving the horizontal control element alters suspension angles of the plurality of cables providing a corresponding tilt of the seat support and seat.

2. The motion simulation chair of claim 1 wherein the plurality of support cables comprises four cables.

3. The motion simulation chair of claim 2 wherein each cable is located at a support corner laterally displaced from a centerline of the seat support.

4. The motion simulation chair of claim 1 further comprising a rear vertical control element depending from the horizontal control element distal the forward control vertical element, the rear vertical control element constrained laterally to prevent yaw of the seat support.

5. The motion simulation chair defined in claim 4 wherein the rear vertical control element comprises a rod and further comprising a second ball joint connected to a telescoping support, the ball joint receiving the rod to constrain lateral motion.

6. The motion simulation chair of claim 1 wherein the forward vertical element comprises a post and further comprising a ball mount receiving the forward vertical control post, the ball mount acting as the control point.

7. The motion simulation chair of claim 1 wherein the means for imparting motion comprises a control column connected to the forward vertical element.

8. The motion simulation chair defined in claim 7 further comprising means for mounting a computer video game controller.

9. The motion simulation chair defined in claim 1 further comprising a motion sensor for measuring motion of the forward vertical control element.

10. A motion simulation chair comprising:

a seat pan having a support base depending therefrom with four support columns each connected at a bottom to suspending cables;

a base receiving the support base and having elevated support landings connected to the suspending cables;

a forward vertical control post supported for multiple axis motion in a ball joint connected to the base, said post having a rigid horizontal connection to the seat support extending therefrom upwardly displaced from the ball joint;

a rear vertical control rod extending downward from the rigid horizontal connection distal from the forward vertical control post, the rod engaged in a receiver providing lateral constraint with longitudinal and axial freedom of motion; and, a control column connected to the forward vertical control post.

11. The motion simulation chair of claim 10 wherein the seat pan incorporates a plurality of engagement slots and further comprising a seat back adjustably received in a desired one of the engagement slots.

12. The motion simulation chair of claim 10 further comprising a leg support extending from the seat pan.

13. The motion simulation chair of claim 10 further comprising an integrated landing in the base for connection of the ball joint and further comprising a motion sensor for detecting motion of the forward vertical control post.

14. A motion simulation chair comprising:

a seat, means depending from the seat with connection points for attachment of a plurality of suspension cables;

a base having elevated attachment points for the suspension cables; and, a forward vertical control post supported for multiple axis motion in a ball joint connected to the base, said post having a rigid horizontal connection to the seat extending therefrom upwardly displaced from the ball joint;

a rear vertical control rod extending downward from the rigid horizontal connection distal from the forward vertical control post, the rod engaged in a receiver providing lateral constraint with longitudinal and axial freedom of motion; and, a control column connected to the forward vertical control post.

15. A motion simulation chair comprising:

a base providing elevated attachment points for a plurality of support cables;

a seat support carried within the base and engaging a seat for an occupant at a top end and having companion attachment points for the plurality of cables at a bottom end;

a control system having means for control input;

means for mechanical leverage connected to the control input means and engaging the seat support and further engaging a multiple axis pivot point attached to the base, input force from said control input means imparting motion to the seat support constrained in the support cables and reacted by the pivot point through the mechanical leverage means, said imparted motion increasing a depending angle of a portion of the plurality of cables while decreasing a depending angle of a second portion of the plurality of cables to induce tilting of the seat support.

* * * * *